US011267104B2

(12) United States Patent
Engvall et al.

(10) Patent No.: US 11,267,104 B2
(45) Date of Patent: Mar. 8, 2022

(54) ADJUSTING PLIERS

(71) Applicant: Stanley Black & Decker Inc., New Britain, CT (US)

(72) Inventors: David E. Engvall, Towson, MD (US); Christopher Lee Laidlaw, Huntersville, NC (US)

(73) Assignee: Stanley Black & Decker Inc., New Britain, CT (US)

( * ) Notice: Subject to any disclaimer, the term of this patent is extended or adjusted under 35 U.S.C. 154(b) by 372 days.

(21) Appl. No.: 16/174,203

(22) Filed: Oct. 29, 2018

(65) Prior Publication Data

US 2019/0126441 A1 May 2, 2019

Related U.S. Application Data

(60) Provisional application No. 62/578,149, filed on Oct. 27, 2017.

(51) Int. Cl.
*B25B 7/10* (2006.01)
*B25B 7/12* (2006.01)

(52) U.S. Cl.
CPC . *B25B 7/10* (2013.01); *B25B 7/12* (2013.01)

(58) Field of Classification Search
CPC .... B25B 7/10; B25B 7/02; B25B 7/04; B25B 7/12; B25B 7/14; B25B 7/18; B25B 13/00; B25B 13/10; B25B 13/105; B25B 13/12; B25B 13/16; B25B 13/18; B25B 13/20; B25B 13/22; B25B 13/48; B25B 13/56; B25B 13/58; B25G 1/105
See application file for complete search history.

(56) References Cited

U.S. PATENT DOCUMENTS

| | | | | |
|---|---|---|---|---|
| 6,508,149 | B1 * | 1/2003 | Heggemann | B25B 7/12 81/313 |
| 7,299,724 | B1 * | 11/2007 | Warheit | B25B 7/00 81/321 |
| 7,669,505 | B2 * | 3/2010 | Campbell | B25B 7/14 81/409 |
| 9,862,074 | B2 * | 1/2018 | Wang | B25B 7/14 |
| 10,744,622 | B2 * | 8/2020 | Herrmann | B25B 7/10 |
| 2009/0056510 | A1 * | 3/2009 | Buchanan | B25B 7/10 81/355 |
| 2010/0064861 | A1 * | 3/2010 | Herrmann | B25B 7/10 81/409 |

* cited by examiner

*Primary Examiner* — Robert J Scruggs
(74) *Attorney, Agent, or Firm* — Caeden C. Drayton

(57) ABSTRACT

A device and method for clamping an object, in particular, the device includes a top jaw having a bottom handle, a slot, and a series of ridges around the slot and top handle with distal end including joint pegs. A pin or button, which includes an engagement element, is provided for extending through the slot. The bottom jaw can include recess for receiving a pin or button. The bottom jaw can include at least one detent adapted to receive at least one part of the top of at least one handle. In addition, a bottom jaw is adapted to connect with a distinct part of at least one handle that is adapted for receiving the pin. The top jaw and bottom jaw pivot about an axis of the pin, and the engagement element is moveable along the same axis from a first position to a second position.

20 Claims, 15 Drawing Sheets

ADJUSTING PLIERS

This patent application claims priority to U.S. Provisional Patent Application Ser. No. 62/578,149, filed Oct. 27, 2017, which is hereby incorporated by reference in its entirety.

FIELD OF INVENTION

This invention relates generally to pliers devices, and more particularly, to pliers devices that can be adjusted to several positions.

BACKGROUND

Pliers are known for gripping articles and for applying a turning force to an article. Pliers typically comprise a pair of members pivoted to one another for relative movement, such as described in U.S. Pat. No. 7,040,201B2. Usually one end of the members include jaws for gripping the article and the other end of the members are formed as handles for manually applying a gripping force to the jaws and a turning force to the pliers. Mechanisms are known for adjusting the distance between the jaws to allow the jaws to grip articles of varying size. One type of mechanism allows the user to push a button to release the engagement of the members from one another and to allow the jaws to be moved relative to one another to adjust the spacing. An improved adjusting pliers stabilizing and/or alignment features is desired.

SUMMARY OF THE INVENTION

Pliers are known for gripping articles and for applying a turning force to an article. Pliers typically comprise a pair of members pivoted to one another for relative movement, such as described in U.S. Pat. No. 7,040,201B2. Usually one end of the members include jaws for gripping the article and the other end of the members are formed as handles for manually applying a gripping force to the jaws and a turning force to the pliers. Mechanisms are known for adjusting the distance between the jaws to allow the jaws to grip articles of varying size. One type of mechanism allows the user to push a button to release the engagement of the members from one another and to allow the jaws to be moved relative to one another to adjust the spacing. An improved adjusting pliers stabilizing and/or alignment features is desired.

The present invention provides a device and method for clamping an object with adjusting pliers. In particular, a device is provided with a top jaw having a bottom handle, a slot and a series of ridges, wherein the ridges are located around the slot; a pin that extends through the slot, where the ridges are located around the slot; a top handle, the top handle having distal ends including bores, a bottom jaw, the bottom jaw having a plurality of recesses and an opening, wherein the bottom jaw is attached to the adjusting plier by the pin extending through the bores of the top handle and the slot of the top jaw, an engagement element attached to the pin, wherein the engagement element engages at least one of the series of ridges in a first position, wherein the top jaw and the bottom jaw pivot about a first axis that extends through a longitudinal axis of the pin, and wherein the engagement element is movable along the first axis from the first position to a second position wherein the engagement element does not engage any of the series of ridges.

In another embodiment, a plurality of stop members define a stop point for perpendicular movement of the top handle to the slot of the top jaw.

In an alternative embodiment, the plier device is provided with a top jaw having a bottom handle, a slot and a series of ridges, wherein the ridges are located around the slot, a pin that extends through the slot, where the ridges are located around the slot, a top handle, the top handle having distal ends including bores, a bottom jaw, the bottom jaw defining a plurality of spaces within said bottom jaw for receiving the top jaw and the top handle, an engagement element attached to the pin, wherein the engagement element engages at least one of the series of ridges in a first position, wherein the top jaw and the bottom jaw pivot about a first axis that extends through a longitudinal axis of the pin, and wherein the engagement element is movable along the first axis from the first position to a second position wherein the engagement element does not engage any of the series of ridges.

In yet another alternative embodiment, the plier device is provided with a top jaw having a bottom handle, a slot and a series of ridges, wherein the ridges are located around the slot, a pin that extends through the slot, where the ridges are located around the slot, a top handle, the top handle having distal ends including bores, a bottom jaw, the bottom jaw having a plurality of spaces within said bottom jaw for receiving the top jaw and the top handle, an engagement element connected to the pin, wherein the engagement element engages at least one of the series of ridges in a first position, wherein the top jaw and the bottom jaw pivot about a first axis that extends through a longitudinal axis of the pin, and wherein the engagement element is movable along the first axis from the first position to a second position wherein the engagement element does not engage any of the series of ridges.

In another embodiment, at least one jaw includes a supporting wall. The supporting wall can add additional stability to the gripping of the pliers requiring less force from a user. The supporting wall can also add improved alignment resulting in less catching of the teeth during adjustment.

In another embodiment, the top handle includes a channel that can be placed on top of the outer surface of at least one jaw.

In another embodiment, at least one part of the pin is slanted or scooped for engaging into a recess of a top handle or engagement element.

In at least one embodiment, the invention relates to pliers having two pliers jaws of which one sits fixedly on one pliers limb which, for quick or easy adjustment of the pliers, has a longitudinal slot guide for adjusting of the plier jaws by one of a push button or by a biasing force which causes the bottom jaw to translate towards the top jaw when an engagement element engages at least one of the series of ridge, and of which the other jaw is guided on a separate pliers limb carrying the adjusting jaw and can be shifted, via a force-transmission point or adjustment from the bottom of the longitudinal slot guide to the top of said slot guide, a pin for engaging into a recess of the bottom jaw, and a supporting back wall for bracing the bottom and top jaw.

One embodiment of the invention is an adjusting pliers device including a top jaw having a bottom handle, a slot and a series of ridges, wherein the ridges are located around the slot; a pin that extends through the slot; wherein the ridges are located around the slot; a bottom jaw including a plurality of recesses, a top handle and another opening for receiving the pin; and an engagement element attached to the pin, wherein the engagement element engages at least one of the series of ridges in a first position, wherein the top jaw and bottom jaw pivot about a first axis that extends through a longitudinal axis of the pin, and wherein the engagement element is moveable along the first axis from the first position to a second position wherein the engagement element does not engage any of the series of ridges.

In another embodiment, the stabilizing pliers the bottom jaw includes at least part of the pin slanted or sloped for engaging into the recess of the bottom jaw.

One embodiment of the invention is adjusting parallel jaw tool. This tool produces a parallel movement of the lower jaw by riding on the front of the top jaw and inside the slot in the top jaw. The lower jaw can ride the top jaw by a biasing force on a handle that is structurally separate from the lower jaw. The lower jaw can be structured to receive the top of at least one handle when pushing or pulling the lower and top jaw apart or together. The lower jaw can be adjusted by the biasing force of the handle in connection with at push button mechanism configured for engaging at least one ridge located adjacent to the top jaw and a circular extension of the handle. The push button mechanism can include an engagement assembly comprised of a pawl, spring, and a pin to engage a number of ridges for adjusting the lower jaw placement onto a number of ridges located in a slot of the top jaw. The adjustment release results from opening the top handle all the way open releasing the pawl from the rack of teeth inside the slot. The bottom jaw can also include a parallel jaw or supporting wall that wraps around the top jaw section. This parallel jaw or supporting wall can assist in the stabilization of the gripping action of the plier jaws and/or stabilization of the movement of the adjusting features of moving the lower jaw along the slot located in the top jaw. The parallel jaw or supporting wall can also include a channel or groove for placement onto a first wall of the top jaw. This channel or groove can add additional stability for gripping or moving the lower jaw in relation to the top jaw. The channel or groove can also provide improved alignment of the pliers when adjusting the plier jaws. The lower jaw can also include an inner channel or groove for placement onto a second wall and provide further stability or alignment of the pliers.

In at least one embodiment, at least one plier jaw can include a number of a wide rail that gives the jaw sliding a "drawer effect" that minimizes the pliers catching and improves alignment of adjusting the plier jaws.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the root terms "include" and/or "have", when used in this specification, specify the presence of stated features, steps, operations, elements, and/or components, but do not preclude the presence or addition of at least one other feature, step, operation, element, component, and/or groups thereof.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus.

For definitional purposes and as used herein, "connected" or "attached" includes physical or electrical, whether direct or indirect, affixed or adjustably mounted, as for example, " . . . the plurality of wiping terminals is operatively connected to the electric circuit." Thus, unless specified, "connected" or "attached" is intended to embrace any operationally functional connection.

As used herein, "substantially," "generally," "slightly", "approximate" and other words of degree are relative modifiers intended to indicate permissible variation from the characteristic so modified. It is not intended to be limited to the absolute value or characteristic which it modifies but rather possessing more of the physical or functional characteristic than its opposite, and approaching or approximating such a physical or functional characteristic.

In the following description, reference is made to the accompanying drawings which are provided for illustration purposes as representative of specific exemplary embodiments in which the invention may be practiced. Given the following description of the specification and drawings, the apparatus and methods should become evident to a person of ordinary skill in the art. Further areas of applicability of the present teachings will become apparent from the description provided herein. It is to be understood that other embodiments can be utilized and that structural changes based on presently known structural and/or functional equivalents can be made without departing from the scope of the invention.

BRIEF DESCRIPTION OF THE DRAWINGS

The above-mentioned and other features, embodiments, and advantages of this invention, and the manner of attaining them, will become more apparent and the invention will be better understood by reference to the following descriptions of embodiments of the invention taken in conjunction with the accompanying drawings, wherein.

Corresponding reference characters indicate corresponding parts throughout the several views. The exemplifications set out herein illustrate embodiments of the present invention, and such exemplifications are not to be construed as limiting the scope of the present invention in any manner.

These and other features of the invention will become apparent upon review of the following detailed description of the presently preferred embodiments of the invention, taken into conjunction with the appended figures.

DESCRIPTION

With reference now to the attachments, summary, apparatuses, systems, and methods embodying features, principles, and concepts of various exemplary embodiments of an adjusting pliers/wrench will be described.

The tool works like an adjustable pliers/wrench with the adjustment accomplished by a ratcheting mechanism. The fine adjustment and clamping on a work piece is accomplished by squeezing a "plier" handle forcing the parallel jaws together. The plier has the additional functionality of quick or easy adjusting wherein the jaws can be moved closer together by ratcheting the adjusting mechanism without pushing the button. The plier has the additional functionality of providing additional stability with a supporting wall or bracing structure that is affixed to at least one jaw. The pliers/wrench has the additional functionality of providing additional alignment with a supporting wall or bracing structure that is affixed to at least one jaw. The supporting wall is perpendicular of at least one jaw can include an overlapping channel to be placed on top of an extension of another jaw and/or handle. At least one jaw is distinct and separate from either handle.

Figure 1:
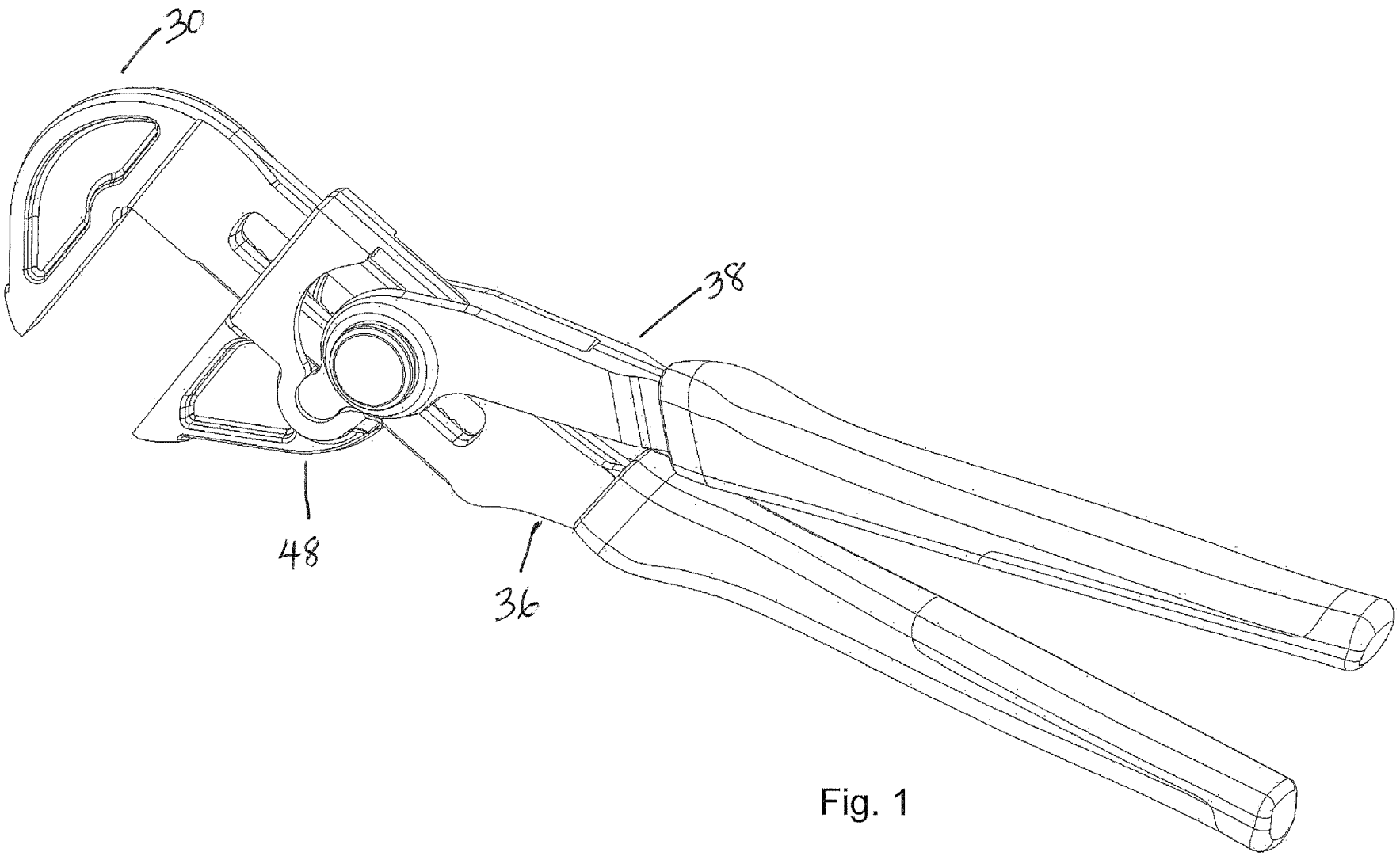
FIG. 1 is a perspective front view of the adjusting plier device according to one embodiment of the present invention.
Figure 2:
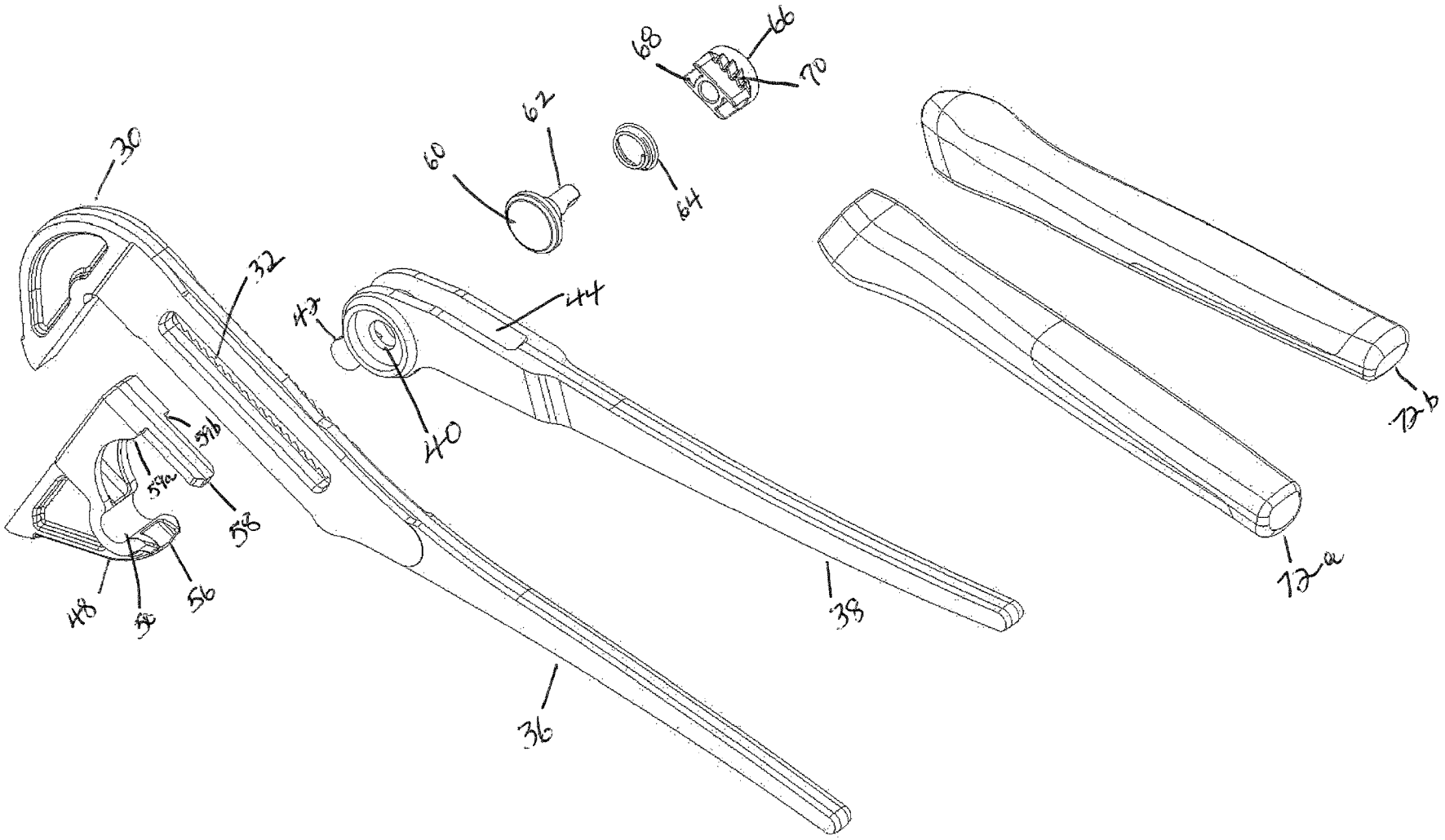
FIG. 2 is an exploded, front view of the adjusting plier device of FIG. 1.

Referring to FIG. 1, a perspective front view of the adjusting plier device according to one embodiment of the present invention. A top jaw 30 is integrally attached to a bottom handle 36. A bottom jaw 48 is shown coupled with a bottom handle 38. Referring now to FIG. 2 there is an exploded view of the adjusting plier and depicts the top handle 30 integrally attached to the bottom handle 36. The top jaw 30 also depicts a slot 32 formed therein and a series of ridges 34 (fully shown in FIG. 3) formed on both sides of the slot 32 and above the bottom handle 36. Also shown is the bottom jaw 48 unattached to the top handle 38. The top handle 30 has distal ends including bores 40 and also joint pegs 42 for placement into a recess of the bottom jaw 48. A channel 44 is provided between the distal ends of the top handle 38 for receiving part of the top jaw 30. FIG. 2 also illustrates the structure and shape of the bottom jaw. Bottom jaw 48 includes a joint recess 50 that is in a position at the lower end of the bottom jaw, a stop surface 54 for the top surfaces of the distal ends of the top handle 38. The stop surface 54 is placed at the approximate open end of the channel 44 of the top handle 38. Bottom jaw 48 also provides for a bracing element 58 to extend in between the channel 44 and engage with at least a part of the top handle 38.

Figure 3:
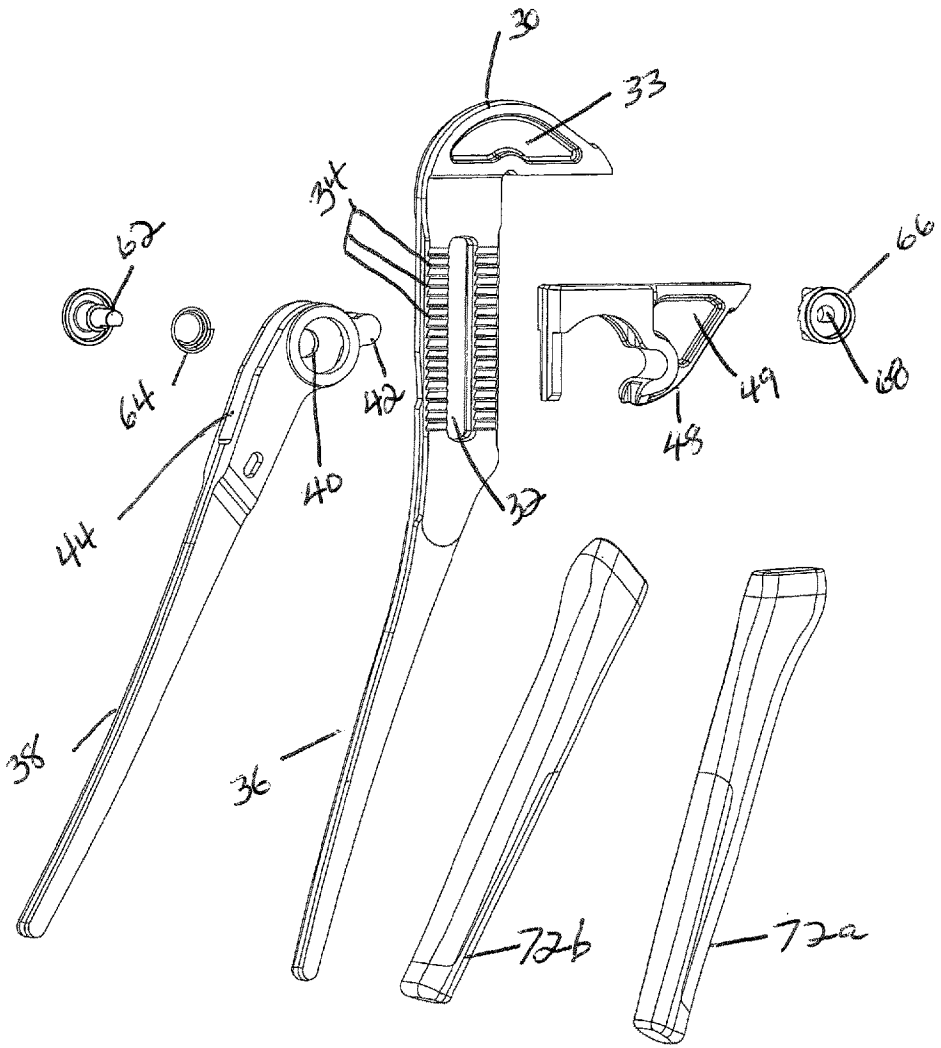
FIG. 3 is an exploded, rear view of the adjusting plier device of FIG. 1.

FIG. 2 and FIG. 3 provide for an engagement assembly comprising a button head 60, a pin 62, a spring 64, and an engagement element 66. The button head 60, pin 62, and engagement element 66 keeps the top jaw 30, bottom jaw 48 and top handle 38 coupled together. In order to couple the top jaw 30, bottom jaw 48, and the top handle 38, the top jaw 30 is placed into an opening at the top of the bottom jaw 48. The channel 44 of the top handle 38 is placed around part of the top jaw 30 and the joint pegs 42 at the distal ends of the top handle are placed into the joint recess 50 of the bottom jaw 48. The pin 62 extends through bores 40, through an opening of the spring 64, and an opening 68 of engagement element 66. With button head 60, pin 62 pivotally connects the top jaw 30, bottom jaw 48, top handle 38, a spring 64, and engagement element 66. FIG. 3 further illustrates the structure and shape of the top jaw 30, bottom jaw 48, top handle 38, and engagement element 66. Top jaw 30 includes a slot 32 formed therein and a series of ridges 34 formed on both sides of the slot 32 and above the bottom handle 36. As shown in FIG. 3, ridges 34 are angled upward in shape. However, ridges 34 may be angled downward, straight, sloped, or curved. Top jaw recess 33 and bottom jaw recess 49 are formed on top jaw 30 and bottom jaw 48, respectively.

FIGS. 4A-4E illustrate the structure of the engagement element 66. On one side of the engagement element 66 is the head. On the other side is an opening 68, an extended portion 69, and the one or more teeth 70. The one or more teeth 70 are provided on the engagement element 66 for engaging one or more of the series of ridges 34. The one ore more teeth 70 extends at least partly beyond the head of the engagement element 66 to engage the ridges 34. In order to promote translation of the engagement element 66 and bottom jaw 48 toward or away to the top jaw 30, ridges 34 are angled upward while the teeth 70 are angled downward. The engagement element 66 and bottom jaw 48 are thus able to freely translate toward the top jaw 30 while being prevented by the ridges (shown in FIG. 3) from translating away from the top jaw 30.

Figure 4A:
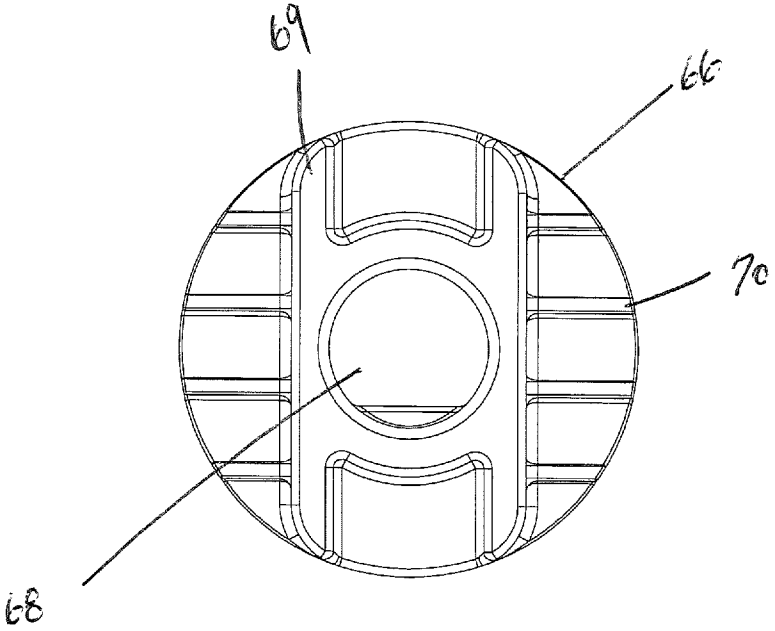
FIG. 4A is a front view of the engagement element of the adjusting plier according to one embodiment of the present invention.
Figure 4B:
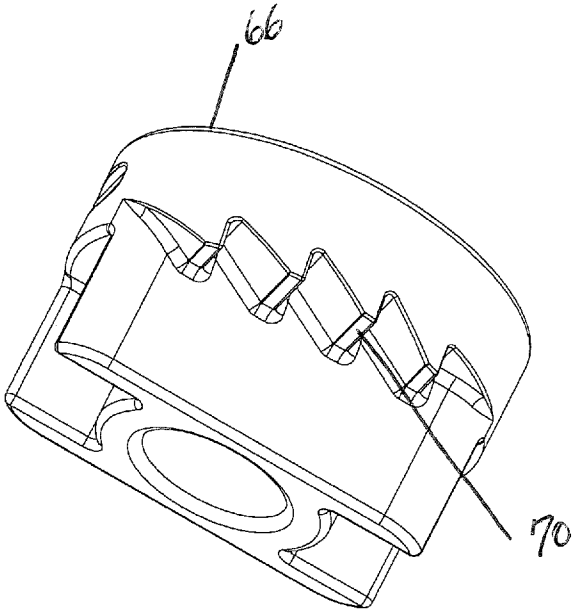
FIG. 4B-4D are perspective views of the engagement element of FIG. 4A.
Figure 4C:
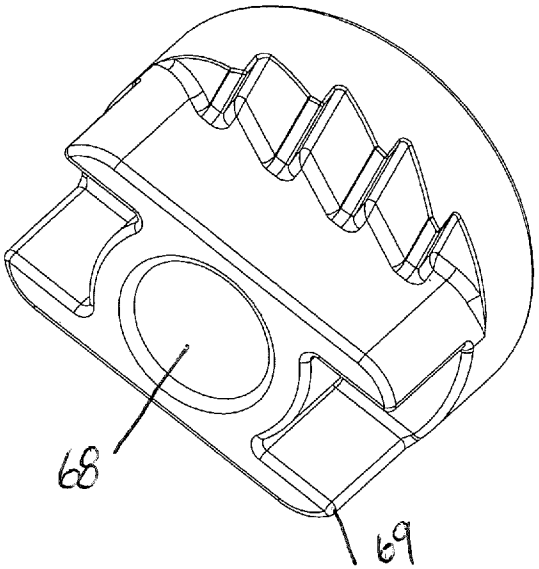
Figure 4D:
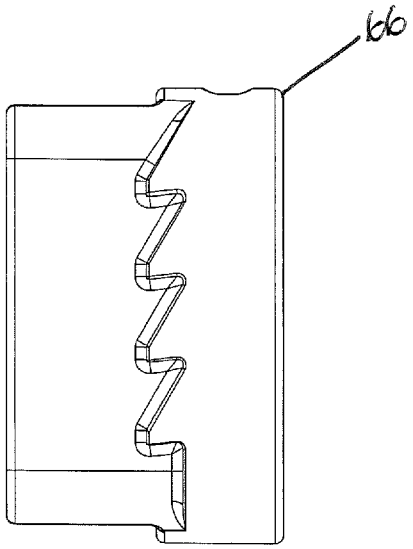
Figure 4E:
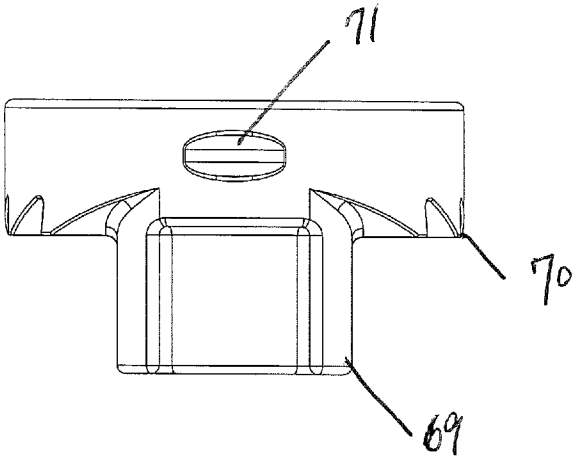
FIG. 4E is a top view of the engagement element of FIG. 4A.

The extended portion 69 as shown in FIGS. 4B and 4C illustrate an H shaped extended portion 69 for placement substantially against the inner walls of the slot 32 for providing stability to the translation of the top handle 38 up and down the slot 32 of the top jaw 30 with the bottom handle 36. The extended portion 69 includes an opening 68 for receiving the pin 62. In this embodiment, the extended portion 69 is H shaped and formed substantially along the length the teeth 70 but may be a square or rectangular block, round, oval, or polygon shape of any suitable size for placement substantially against a part of inner walls of the slot 32. FIG. 4E further illustrates the structure and shows a top view of the engagement element 66 and depicts depression 71 at the top of engagement element 66. Engagement element 66 is moveable relative to the ridges 34 to allow for engagement or disengagement of said ridges 34.

Figure 5:
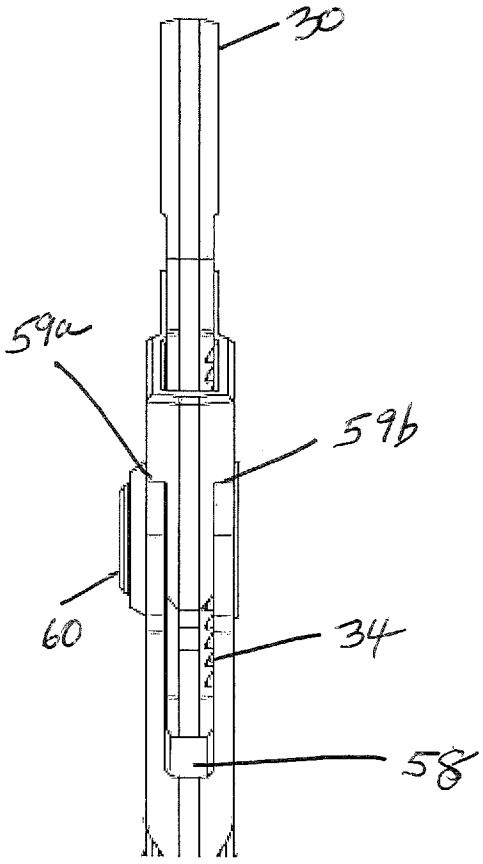
FIG. 5 is a partial, top view of the adjusting plier device of FIG. 1.

FIG. 5 illustrates a top view of the adjusting plier of FIG. 1. Top jaw 30 is contained in the opening at the top of bottom jaw 48. Button head 60 and pin 62 (not shown) extends through bores 40 (not shown) of top handle 38 and opening 68 of engagement element 66 to couple top jaw 30, bottom jaw 48, and top handle 38. Bracing element 58 is placed against part of the top handle surfaces 39*a*, 39*b* (shown in FIG. 10) of top handle 38. Top jaw 30, bottom jaw 48, and top handle 38 pivot about a first axis that extends through a longitudinal axis of the pin 62 and button head 60. The engagement element 66 and bottom jaw 48 are movable since the engagement element 66 can be engaged and disengaged by ridges 34 as described above. In another embodiment, straight ridges 34 along with corresponding straight teeth 70 may be used. In another embodiment, curved ridges 34 may be used along with at least one tooth 70.

Figure 6:
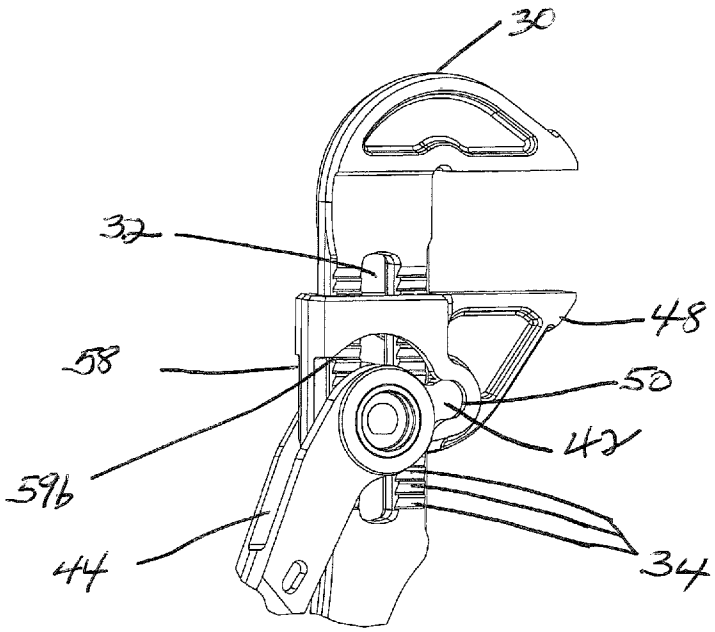
FIG. 6 is a partial, rear view of the adjusting plier device of FIG. 1.

FIG. 6 illustrates a partial, rear view of the adjusting plier of the present invention. Ridges are angled upward and located at the upper end of slot 32. However, ridges 34 may be angled downward, straight, sloped, or curved. Top jaw 30, top handle 38, slot 32, pin 62 and function as described above. FIG. 6 depicts the adjusting plier with the top handle 38 unbiased against the bracing element 58.

Figure 7:
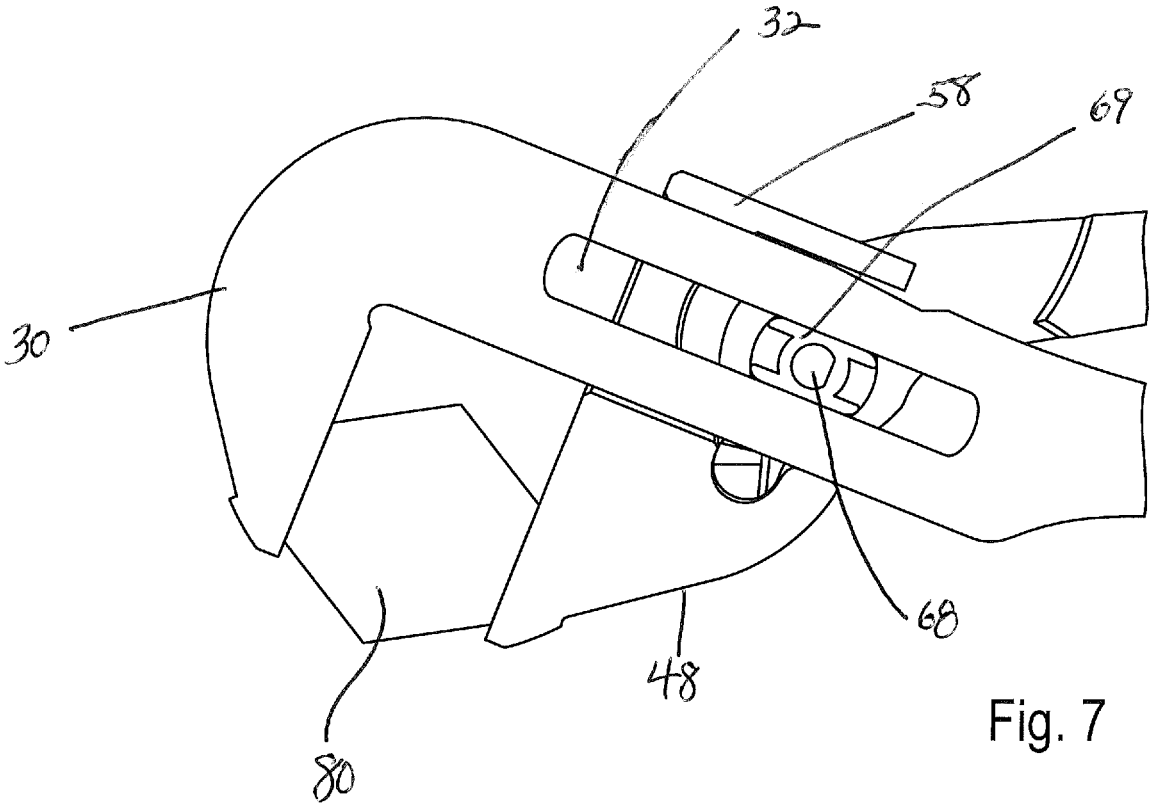
FIG. 7 is a partial, cutaway view of the adjusting plier of FIG. 1 with the jaws closed around an exemplary hex bolt between the top jaw and the bottom jaw.
Figure 8:
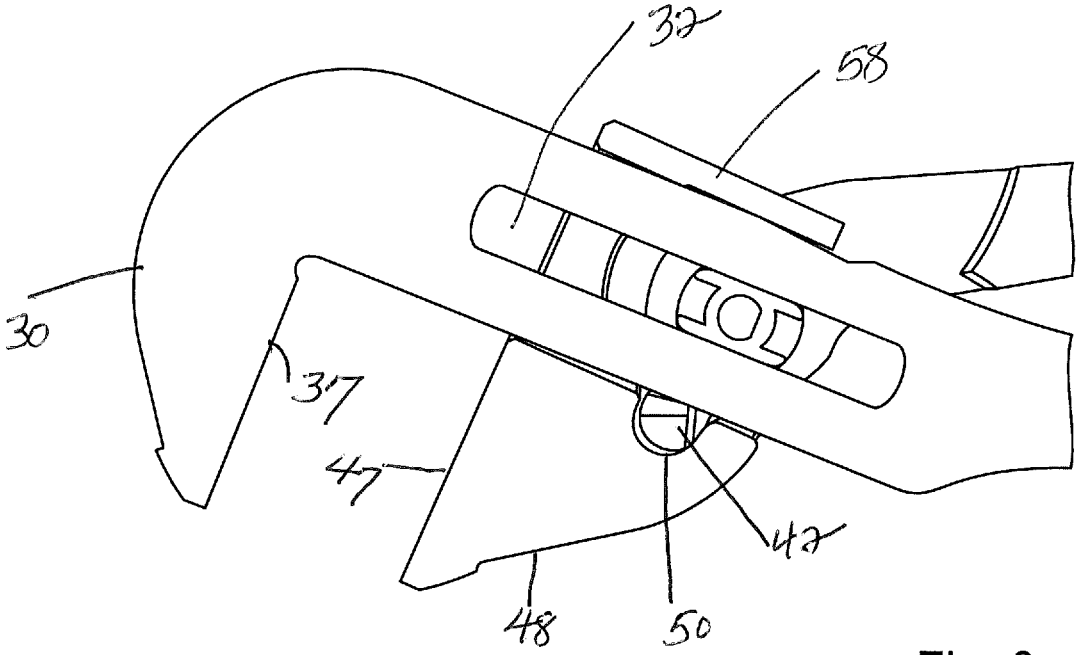
FIG. 8 is a partial, cutaway view of the adjusting plier of FIG. 1 in an open position.

FIGS. 7 and 8 illustrate partial, cutaway views of the adjusting plier. FIG. 7 illustrates the top jaw 30 and the bottom jaw 48 gripping an exemplary hex bolt 80. The top handle is biased against the bracing element 58. As shown in FIG. 7 the extended portion 69 is against the inner walls of the slot 32. FIG. 8 illustrates a top grip 37 of the top jaw 30 and a bottom grip 47 of bottom jaw 48 without an object for gripping. The top grip 37 and the bottom grip 47 are illustrated as flat surfaces engaging or clamping on to a work piece, however may include teeth for gripping. As shown in FIG. 8, the top handle 38 is unbiased against the bracing element 58 and the extended portion 69 is substantially against the inner walls of the slot 32. FIG. 8 further illustrates joint pegs 42 of the top handle 38 placed in the joint recess 50 of the bottom jaw 48.

Figure 9:
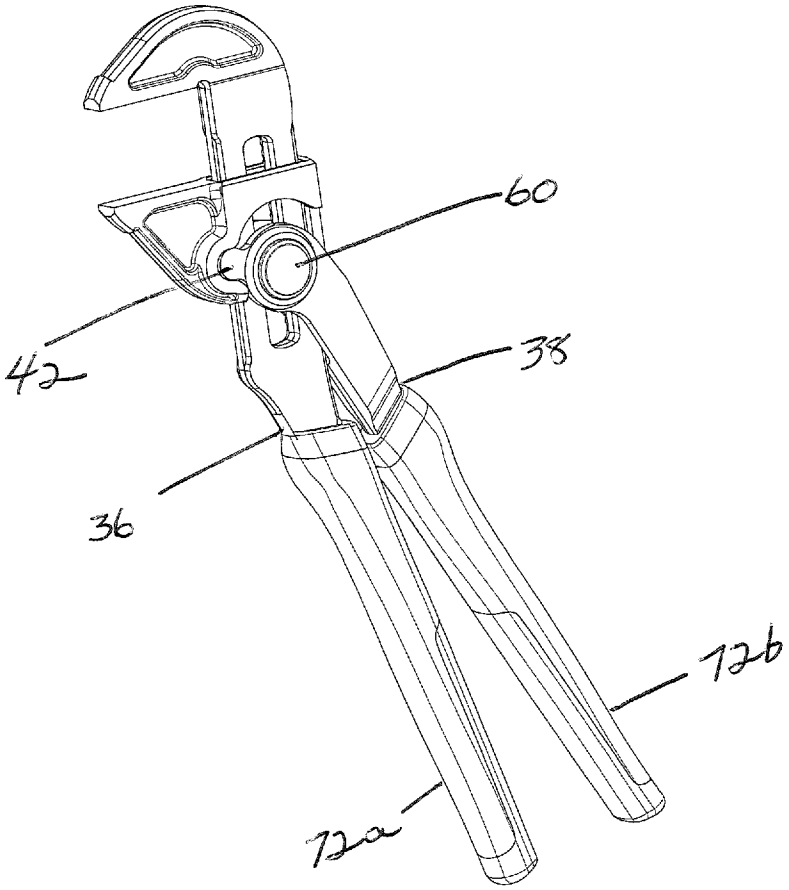
FIG. 9 is a front cutaway view of the adjusting plier of FIG. 1 in an open position with the bottom jaw at a position perpendicular to the slot.
Figure 10:
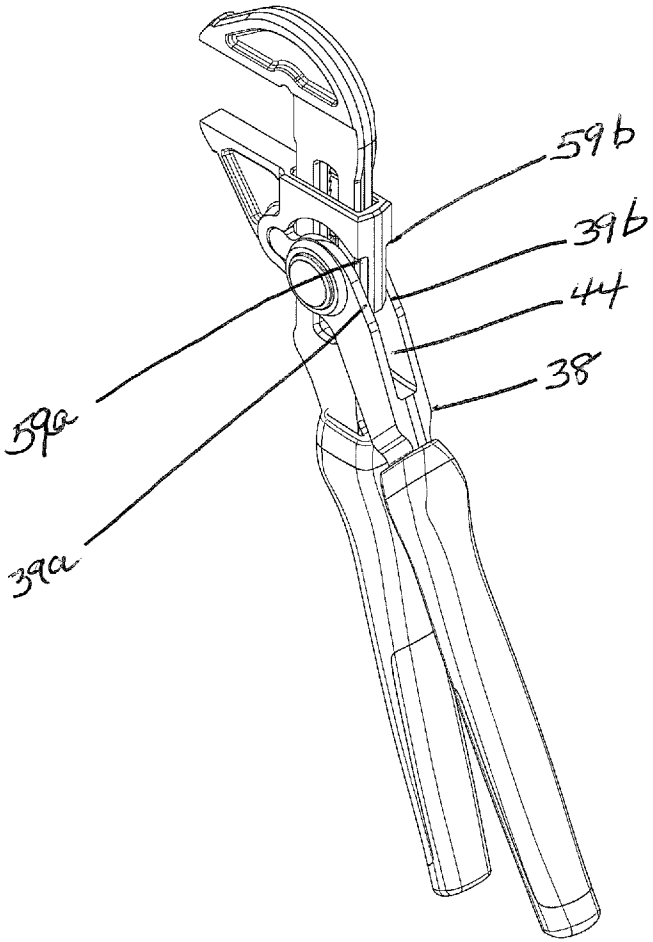
FIG. 10 is a side perspective view of FIG. 1 in an open position with the bottom jaw at a position perpendicular to the slot.

Referring now to FIGS. 9 and 10, the adjusting plier device of the present invention is illustrated. As previously shown in FIGS. 2 and 3, the engagement assembly includes the head 60, pin 62, spring 64, and the engagement element or pawl 66. The head is a push button but may be switch, or knob configured to engage the spring for actuation of the engagement element 66 to the ridges 34. Head button 60 is connected to one end of pin 62. Spring 64 may be placed around the pin 62 and against the extended portion 69 so as to bias against the engagement element 66 for translation the element 66 up and down the slot. Placing the teeth 70 adjacent to the pivot in this embodiment provides more positive and reliable engagement with ridges 34. FIG. 9 is a front perspective view of the adjusting plier in an open position with the bottom jaw at a position perpendicular to the slot and FIG. 10 is a side perspective view of the plier in an open position with the bottom jaw at a position perpendicular to the slot. In addition, the top handle 38 and bottom handle 36 have an elastomeric material fitted around their exteriors 72*a*, 72*b* making the handles slightly thicker. In this embodiment, the materials are fitted around the handles 36,38 and are elastomeric but any polycarbonate material may be used.

As shown in FIGS. 2-3 and 9-10 the engagement assembly and the top handle 38 interact with the top jaw 30 and the bottom jaw 48 to grip or release an object. When pressed, the button head 60 of the engagement assembly pulls the teeth 70 of the engagement element 66 out of ridges 34. Thus the extended portion 69 pivots about a second axis that is parallel to the first axis so that the bottom jaw 48 can move away from the top jaw 30 and release an object, for example, hex bolt 80 in FIG. 7. This allows the bottom jaw 48 to freely move toward or away from top jaw 30 to provide either a smaller or larger opening between the jaws, 30, 48 of the device. In order for the jaws of the device to clamp an object, the teeth 70 of the engagement element 66 engage a ridge 34 that corresponds to the shape of the object being clamped.

Top handle 30 then pivots about pin 62, which is translationally fixed due to engagement between the teeth of the engagement element and the correct ridge. The jaws 30, 48 can be closed around or grip an object by moving the top handle 38 upward or forward while holding the bottom handle 36 in place. Gripping an object can also occur by pressing the button head 60 and moving the top handle 38 upward or forward while holding the bottom handle 36 in place. Alternatively, an object can be released by pressing the button head 60 and moving the top handle 38 downward. When there is no object to be gripped and top jaw 30 and bottom jaw 48 contact one another, the tool can stay in this position which allows for easy storage. When there is no object to be gripped and top jaw 30 and bottom jaw 48 are not in contact with one another, the plier tool can also stay in this position. The plier tool can remain in this open position without bias on the top handle 38 or actuation of the push button head 60. FIG. 10 also illustrates bottom jaw 48 includes stop members 59*a*, 59*b* that prevents top jaw 30 from being opened too wide by preventing the top handle surfaces 39*a*, 39*b* beyond a certain point.

Figure 11:
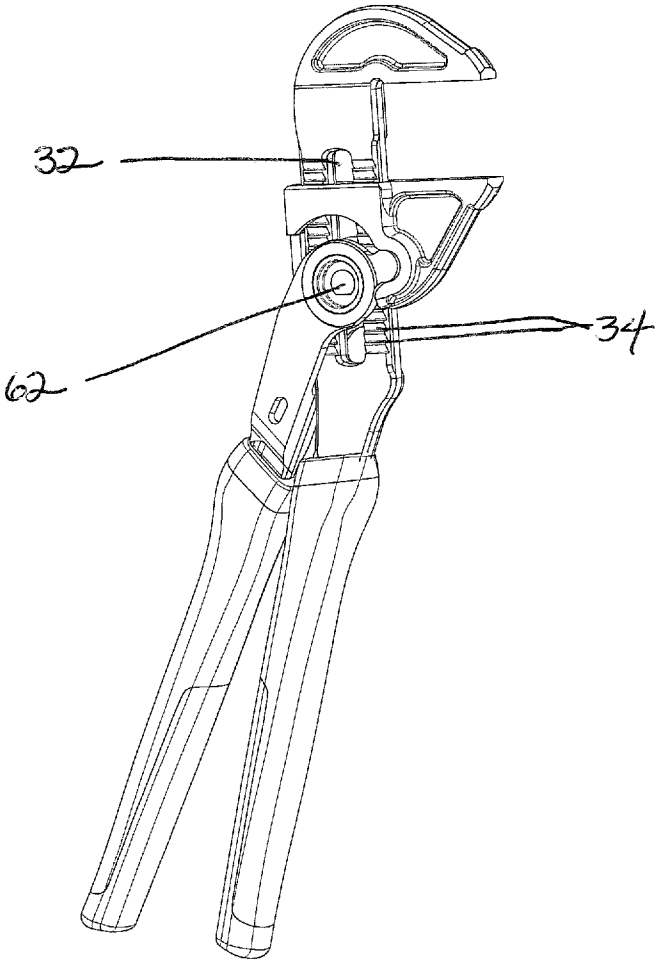
FIG. 11 is a rear perspective view of another embodiment of the adjusting plier of in an open position with the bottom jaw at a position perpendicular to the slot.
Figure 12:
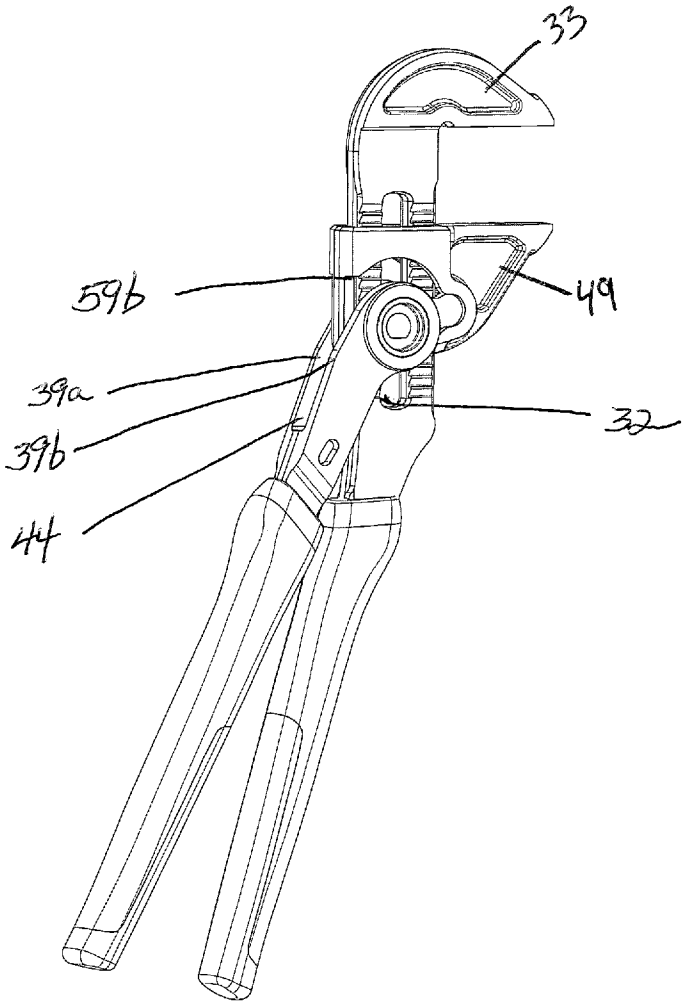
FIG. 12 is a side perspective view of FIG. 1 in an open position with the bottom jaw at a position perpendicular to the slot.

FIG. 11 illustrates another embodiment of the present invention with the top jaw, bottom jaw and top handle in an open position. FIG. 11 is a rear perspective view of the adjusting plier of FIG. 1 in an open position with the bottom jaw at a position perpendicular to the slot with ridges 34 angled downward. The top handle 38 is unbiased against bracing member 58. FIG. 12 is a side perspective view of FIG. 1 in an open position with the bottom jaw at a position perpendicular to the slot. The top jaw recess 33 and bottom jaw recess 49 are formed on top jaw 30 and bottom jaw 48, respectively, and may provide additional tool durability.

In alternate embodiment, the engagement assembly can include a push button mechanism comprised of a pawl, spring, and a pin to engage a number of ridges for adjusting the lower jaw placement onto a number of ridges located in a slot of the top jaw.

The structural configuration, such as the parallel or supporting wall, or the lower jaw not affixed to a corresponding handle, of the pliers can increase the amount of force the pliers can withstand prior to failure and decrease broken teeth at a button, bent handles, and broken jaws. A premium pull strength of the pliers may be between 3000-3500 peak force (lbf), for example. The structural configuration of the pliers may increase the amount of torque, such as rotation around a round bar, the pliers can withstand prior to failure and decrease broken teeth at a button, bent handles, and broken jaws. A premium or peak torque of the pliers may be between 300-350 torque (ft-lb), for example.

The example and alternative embodiments described above may be combined in a variety of ways with each other. Furthermore, the steps and number of the various steps illustrated in the figures may be adjusted from that shown.

It should be noted that the present invention may, however, be embodied in many different forms and should not be construed as limited to the embodiments set forth herein; rather, the embodiments set forth herein are provided so that the disclosure will be thorough and complete, and will fully convey the scope of the invention to those skilled in the art. The accompanying drawings illustrate exemplary embodiments of the invention.

Although the present invention has been described in terms of particular example and alternative embodiments, it is not limited to those embodiments. Alternative embodiments, examples, and modifications which would still be encompassed by the invention may be made by those skilled in the art, particularly in light of the foregoing teachings.

Those skilled in the art will appreciate that various adaptations and modifications of the example and alternative embodiments described above can be configured without departing from the scope and spirit of the invention. Therefore, it is to be understood that, within the scope of the appended claims, the invention may be practiced other than as specifically described herein.

What is claimed is:

1. An adjusting plier device comprising:

a top jaw having a bottom handle, a recess, a slot and a series of ridges, wherein the ridges are located around the slot;

a pin that extends through the slot, where the ridges are located around the slot;

a top handle, the top handle having distal ends including bores;

a bottom jaw, the bottom jaw having a plurality of recesses and an opening, wherein the bottom jaw is attached to the adjusting plier by the pin extending through the bores of the top handle and the slot of the top jaw;

a h shaped engagement element operatively attached to the pin, wherein the engagement element is configured to engage at least one of the series of ridges in a first position, wherein the top jaw and the bottom jaw pivot about a first axis that extends through a longitudinal axis of the pin, and wherein the engagement element is movable along the first axis from the first position to a second position without engaging any of the series of ridges.

2. The adjusting plier of claim 1, wherein top handle includes a channel between the distal ends and configured to hold a part of the top jaw.

3. The adjusting plier of claim 1, wherein the bottom jaw is connected to the adjusting plier by joint pegs of the top handle placed into a recess of the bottom jaw.

4. The adjusting plier of claim 1, wherein a plurality of stop members define a stop point for movement of the top handle to the slot of the top jaw.

5. The adjusting plier of claim 4, wherein the top surfaces of the distal ends engage with the plurality of stop members to prevent movement of the top handle along a second axis.

6. The adjusting plier of claim 1, wherein the top handle can move away from the top jaw while a button on the top handle is pressed.

7. The adjusting plier of claim 1, wherein the bottom jaw can move away from the top jaw while a button on the top handle is pressed.

8. The adjusting plier of claim 1, wherein the engagement element has a opening for receiving the pin and an extended portion adapted to be placed substantially against the inner walls of the slot.

9. The adjusting plier of claim 1, wherein the engagement element can translate along a second axis.

10. An adjusting plier comprising:

a top jaw having a bottom handle, a recess, a slot and a series of ridges, wherein the ridges are located around the slot;

a pin that extends through the slot, where the ridges are located around the slot;

a top handle, the top handle having distal ends including bores;

a bottom jaw, the bottom jaw defining a plurality of spaces within said bottom jaw for receiving the top jaw and the top handle;

a h shaped engagement element operatively attached to the pin, wherein the engagement element is configured to engage at least one of the series of ridges in a first position, wherein the top jaw and the bottom jaw pivot about a first axis that extends through a longitudinal axis of the pin, and wherein the engagement element is movable along the first axis from the first position to a second position without engaging any of the series of ridges.

11. The adjusting plier of claim 10, wherein top handle includes a channel between the distal ends and configured to hold a part of the top jaw.

12. The adjusting plier of claim 10, wherein the bottom jaw is coupled to the plier by placement of joint pegs of the top handle placed into a space of the bottom jaw.

13. The adjusting plier of claim 10, wherein the bottom jaw includes a stop member defining a stop point for movement of the top handle to the slot of the top jaw.

14. The adjusting plier of claim 13, wherein the top surfaces of the distal ends engage with the stop member to prevent movement of the top handle along a second axis.

15. The adjusting plier of claim 10, wherein the top handle can move away from the top jaw while a button on the top handle is pressed.

16. The adjusting plier of claim 10, wherein the bottom jaw can move away from the top jaw while a button on the top handle is pressed.

17. The adjusting plier of claim 10, wherein the engagement element includes an extended portion adapted to be placed substantially against the inner walls of the slot.

18. The adjusting plier of claim 10, wherein the engagement element can translate along a second axis that is perpendicular to the first axis.

19. A plier comprising:

a top jaw having a bottom handle, a recess, a slot and a series of ridges, wherein the ridges are located around the slot;

a pin that extends through the slot, where the ridges are located around the slot;

a top handle, the top handle having distal ends including bores;

a bottom jaw, the bottom jaw having a plurality of spaces within said bottom jaw for receiving the top jaw and the top handle;

a h shaped engagement element operatively connected to the pin, wherein the engagement element is configured to engage at least one of the series of ridges in a first position, wherein the top jaw and the bottom jaw pivot about a first axis that extends through a longitudinal axis of the pin, and wherein the engagement element is movable along the first axis from the first position to a second position without engaging any of the series of ridges.

20. The plier of claim 19, wherein the engagement element has a number of teeth for engaging the ridges surrounding the slot.

* * * * *